United States Patent [19]

Jordan et al.

[11] 4,158,071

[45] Jun. 12, 1979

[54] METHOD AND APPARATUS FOR POWER COATING OF THREE-PIECE CANS

[75] Inventors: Thomas F. Jordan, Oak Park; Robert D. Payne, Countryside, both of Ill.

[73] Assignee: The Continental Group, Inc., New York, N.Y.

[21] Appl. No.: 831,980

[22] Filed: Sep. 9, 1977

[51] Int. Cl.[2] ..... B05B 5/02

[52] U.S. Cl. ..... 427/33; 118/DIG. 10; 118/622; 118/629; 427/181; 427/232

[58] Field of Search ..... 118/DIG. 10, 317, 622, 118/629; 427/28, 30, 33, 232, 233, 235, 236, 237, 181; 239/15

[56] References Cited

U.S. PATENT DOCUMENTS

| | | | |
|---|---|---|---|
| 2,337,740 | 12/1943 | Albright | 118/DIG. 10 UX |
| 2,426,016 | 8/1947 | Gustin et al. | 118/622 X |
| 2,538,562 | 1/1951 | Gustin et al. | 118/622 X |
| 2,939,943 | 6/1960 | Walter | 118/629 X |
| 2,943,001 | 6/1960 | Socke | 118/317 X |
| 3,065,106 | 11/1962 | Rhodes et al. | 427/28 X |
| 3,422,795 | 1/1969 | Smith | 118/317 X |
| 3,575,344 | 4/1971 | Angelico | 239/15 |
| 3,698,636 | 10/1972 | Szasz | 239/15 |
| 3,814,616 | 6/1974 | Kondo et al. | 118/622 X |
| 3,850,660 | 11/1974 | Inamura et al. | 118/622 X |
| 3,901,184 | 8/1975 | Payne et al. | 118/629 |
| 4,081,714 | 3/1978 | Mossel et al. | 427/28 X |

FOREIGN PATENT DOCUMENTS

| | | | |
|---|---|---|---|
| 897881 | 6/1944 | France | 118/317 |
| 48-29300 | 9/1973 | Japan | 427/28 |
| 49-22533 | 6/1974 | Japan | 427/28 |

*Primary Examiner*—Robert Mackey
*Attorney, Agent, or Firm*—Charles E. Brown

[57] ABSTRACT

A method and apparatus for coating the inside of tubular members, more specifically can bodies, which are open at opposite ends. The apparatus includes a supply tube and a return tube which are spaced apart to have received therebetween the tubular member to be coated. In each of the supply tube and the return tube there is positioned a corona electrode, the corona electrodes being in alignment wherein powder supplied to the interior of the tubular member is both initially charged as it passes through the supply tube and is further charged within the tubular member by an electrical field which exists between the two corona electrodes and the tubular member. Powder is supplied to the supply tube through a small diameter passage as compared to the diameter of the supply tube and there is provided a diverter which effects radially outward flow of incoming powder so that the powder is concentrated substantially adjacent the inner surface of the supply tube so that the powder delivered to the tubular member flows substantially entirely along the inner surface of the tubular member. The method and apparatus permits the provision of a thin coating on the tubular member which is uniform in thickness even at opposite ends thereof.

11 Claims, 2 Drawing Figures

METHOD AND APPARATUS FOR POWER COATING OF THREE-PIECE CANS

This invention relates in general to new and useful improvements in coating of tubular members, and more particularly to an apparatus which is suitable for applying a thin uniform coating to the inner surface of can bodies of the three-piece type, i.e. can bodies which are opened at opposite ends.

Commercial three-piece can bodies require a protective interior coating to prevent corrosion of the can metal by the product and to prevent migration into the product of metal ions which might affect the product's flavor or appearance. This protective interior coating is presently applied to can bodies in two steps. First, a thin enamel coating (which provides lubricity during the body forming) is roller-applied in-the-flat to the interior metal surface. During body forming, this first enamel coating is usually scratched and otherwise subjected to minor damage which exposes many small areas of metal. The second coating, a lacquer spray, is applied to the interior prior to end attachment and this second coating, which covers the small damaged areas exposed in the first coating, is extremely wasteful of lacquer, since the majority goes on undamaged areas which require no additional coating.

During the over-cure of both interior coatings, organic solvents are driven off, creating undesirable atmospheric emissions. Increasing regulation of these emissions has stimulated investigation and use of various coating materials which contain no objectionable solvents. Dry powder coating technology has been extensively investigated for can coating due to its solvent-free nature and due to its ability for application (electrostatically) as an extremely thin, pin-hole-free film. The potential benefit of cost and savings and regulatory compliance have stimulated development of a powder application system for inside powder coating of three-piece can bodies.

Materials for the inside coating of can bodies must comply with regulations and must withstand the abuse of can fabrication during end attachment. In addition, the cured coating must not adversely affect the taste or other desirable chacteristics of the contained product. Proprietary powder materials which meet all these requirements have been developed and used in conjunction with the development of the powder applicator of this invention. For example, an epoxy type material which meets regulations and critical flavor requirements has been developed and produced in a particle size average of 15 microns. When properly applied, this material produces a desirable thin pin-hole-free protective coating.

Most specifically, in accordance with this invention, there has been devised an apparatus for the flow through coating of interior surfaces of tubular members, most specifically can bodies. This apparatus includes a supply tube and a return tube which is in axial alignment and axially spaced to have a can body positioned therebetween. Each of the supply tube and the return tube is provided with a centrally located corona electrode with the corona electrode of the supply tube initially charging the powder particles passing through the supply tube and the two corona electrodes in conjunction with the grounded can body forming in the can body an electrical field which results in the further charging of the powder particles. With this arrangement, it has been possible to obtain very thin coatings on can bodies with the coatings being of uniform thinness throughout and there being proper coating at both ends of the can bodies.

The apparatus developed in accordance with this invention also includes means for concentrating the flow of the applied powder adjacent the inner surface of the can body being coated. In conjunction with this, the powder is supplied to the supply tube through a relatively small supply passage and is radially outwardly diverted by means of a diverter positioned between the supply passage and the supply tube so that the powder is concentrated primarily adjacent the inner surface of the supply tube. The entrance end of the supply tube is also configurated to be cooperative with the diverter for the smooth and uniform flow of the powder to its concentrated position.

With the above, and other objects in view that will hereinafter appear, the nature of the invention will be more clearly understood by reference to the following detailed description, the appended claims and the several views illustrated in the accompanying drawings.

Figure 1:
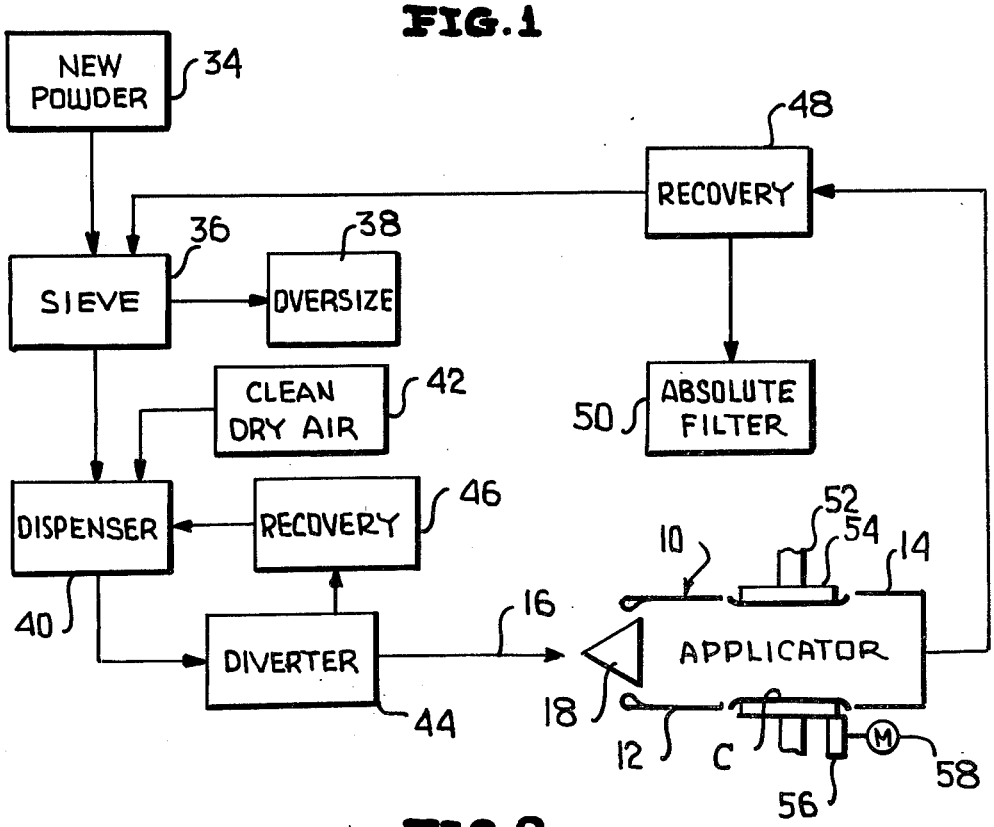
FIG. 1 is a schematic showing of the general system utilized in coating can bodies in accordance with the invention, the system including the specific applicator of this invention.
Figure 2:
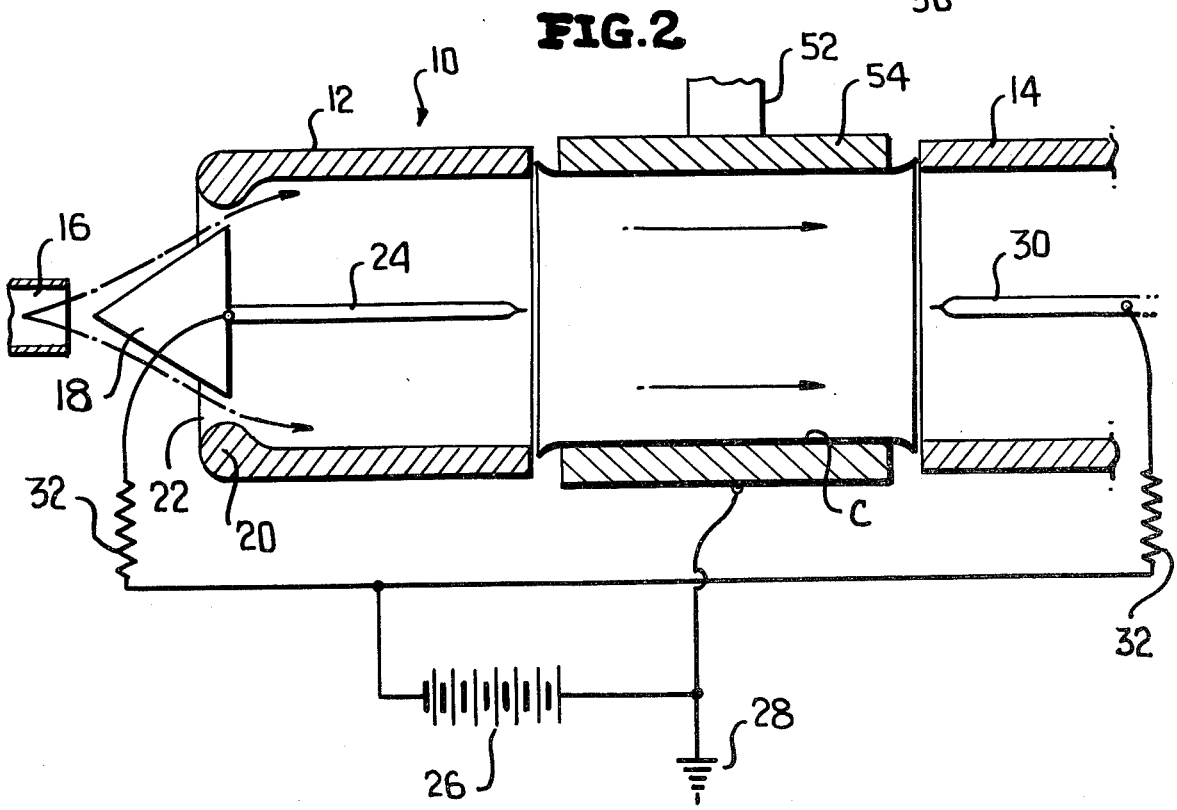
FIG. 2 is an enlarged longitudinal sectional view taken through the applicator and shows the specific details thereof.

Referring now to the drawings in detail, it will be seen that the specific details of the applicator formed in accordance with this invention are illustrated. The applicator is generally identified by the numeral 10 and includes a supply tube 12 and a return tube 14. The tubes 12 and 14 are disposed in axial alignment and are spaced longitudinally with respect to each other. In the operation of the apparatus, a can body C is positioned between the supply tube 12 and the return tube 14. It is to be noted that the can body 10 is of a length so as to substantially fill the space between the supply tube 12 and the return tube 14, but it is not necessary that the can body be in touching, sealing relation with respect to either of the tubes 12 or 14.

It is to be understood that the can body C is of a predetermined internal diameter. The supply tube 12 and the return tube 14 each has an internal diameter substantially equal to that of the can body C.

A powder-air admixture is delivered to the supply tube 12 through a supply passage 16 which is of a diameter substantially less than the diameter of the supply tube 12. A conical diverter 18 is fixedly mounted at the entrance end of the supply tube 12 and has the apex thereof facing the supply passage 16 so that the powder-air admixture delivered by the supply passage 16 is radially outwardly directed.

It is to be noted that the entrance end of the supply tube 12 is restricted by an annular bulge 20 and that the entrance, identified by the numeral 22, into the supply tube 12 is of a rounded configuration. The rounded or curved configuration of the entrance end of the supply tube 12, in conjunction with the diverter 18, causes the flow of the powder-air admixture to be substantially concentrated adjacent the inner surface of the supply tube 12 so that substantially all of the powder delivered to the supply tube 12 is presented to the interior surface of the can body C.

In order that the powder may adhere to the interior surface of the can body C for later fusing and bonding of the powder to the can body C, it is necessary that the powder be electrostatically charged. Accordingly, disposed along the axis of the supply tube 12 is a first corona electrode 24. The corona electrode 24 is connected to an electrically supply source 26 which is grounded as at 28. It is to be understood that the can body which is being coated will also be grounded.

It will be readily apparent that the powder of the powder-air admixture passing through the supply tube 12 will be electrostatically charged and due to the charging of the can body C, it will flow onto and electrically bond to the interior surfaces of the can body C.

It has been observed that utilizing only the corona electrode 24, the coating thickness at the exit end of the can body never achieves a thickness equal to that at the entrance end and the desirable uniform thin coating of powder on the can body C cannot be achieved. Accordingly, in accordance with this invention, a second corona electrode 30 is positioned axially of the return tube 14 and is coupled to the same electrical power source 26. It has been found that the corona electrodes 24, 30 being disposed at opposite ends of the can body C, in conjunction with the grounding of the can body C, forms within the can body C an electric field which additionally charges the powder particles passing through the can body C. In addition, the corona electrodes 24 and 30 effect additional charging of the already deposited powder particles near each end of the can body.

At this time it is pointed out that the electrical power supply 26 is a direct current, high voltage power supply and that each of the corona electrodes 24, 30 are connected to the power supply 26 through a large current limiting resistor (typically 100 Megohms). The resistors are identified by the numeral 32.

It is to be understood that other than the corona electrodes themselves, all parts of the applicator 10 are constructed of dielectric materials to minimize the capacitance of the applicator. This precaution, along with the use of the current limiting resistors 32 prevents the accumulation of sufficient energy to ignite the powder-air mixture within the applicator.

Referring now to FIG. 1, reference is made to the flow diagram of the coating system of this application. It will be seen that new powder is supplied from a powder supply 34 and passes through a sieve 36 which screens out oversize powder particles which are directed to a receptacle 38 for oversize powder particles. These powder particles can be reground for further use.

Powder passing the sieve 36 is directed to a powder dispenser 40 together with clean dry air from an air supply 42. Within the powder dispenser 40, the powder is entrained on the air with the result that a powder-air admixture passes out of the powder dispenser 40 and is directed to a diverter 44. The diverter 44 in and of itself forms no specific part of this invention and, therefore, is not specifically illustrated. The diverter 44 may be one of several different types. In any event, when a can body C is in place within the applicator 10 ready for coating, the powder-air admixture flows into the supply passage 16 and is directed into the applicator 10. On the other hand, when there is no can body in position to be coated, the powder-air admixture is diverted into a recovery system 46 which directs the powder-air admixture back into the powder dispenser 40.

It is to be understood that all powder passing through the supply tube 12 is not deposited on the inner surface of the can body C. Instead, a large amount of the powder passes out of the recovery tube 14 and passes to a recovery device 48 for recirculation back through the sieve 36. Air is withdrawn from the powder-air mixture through a filter 50. It is to be understood that the recovery device 48 is coupled to the recovery tube 14 at a negative pressure so as to draw the excess powder-air mixture into the recovery tube 14 out of the can body C.

At this time it is pointed out that can bodies C are positioned within the applicator 10 sequentially in any desired manner. A most expedious way of presenting the can bodies is by way of a turret 52 having mounted therein a plurality of holders 54 of which only one is illustrated. It is to be understood that with the powder applicator 10, rotation of the can body C is not mandatory. However, use of can body rotation during powder application may provide more latitude in positioning of the can body relative to the supply tube 12 and the recovery tube 14 and the tubes relative to each other. Accordingly, each holder 54 may be mounted for rotation within the turret 52 and in such event, the holder is rotated by means of a drive member, such as a friction wheel 56 coupled to a suitable motor 58.

Operation

A can body C is positioned within the apparatus 10 by the turret 52 and the switching mechanism of the diverter 44 is actuated so as to direct the powder-air admixture into the supply passage 16. After exiting the supply tube 16, the powder-air admixture stream strikes the cone-shaped deflector or diverter 18 so as to produce a diversion cone-shaped powder-air admixture stream. The stream thus produced enters the cylindrical supply tube or shroud 12 where it is shaped into a hollow cylindrical cloud prior to entering the can body C. At this time the can body is electrically grounded. Because of only finite coating time is available (0.333 secs. at 120 cans per minute), there will always be some of the powder which is insufficiently charged for deposition within the can body. Undeposited powder is collected and pneumatically conveyed away from the recovery tube 14 under a vacuum. The supply tube 12 and the recovery tube 14 are identical in diameter and are selected to match the size of the can body being coated. It is to be particularly noted that the supply tube 12 and the recovery tube 14 are positioned so as not to touch the flanged end of the can body. During the powder coating cycle, powder is prevented from escaping through the small gap at each end of the can body by the negative pneumatic pressure of the recovery system.

Undeposited powder which has been collected by the recovery system is sieved to remove agglomerates and contaminents and then mixed with new powder entering the closed loop system. This allows at least 99% utilization of the powder coating material entering the system. This is a marked advantage over a typical liquid spray system which can utilize no more than 85–90% of the liquid coating material consumed.

Using the powder applicator 10 and the epoxy powder developed for use therein, numerous can bodies have been powder coated and packed for both critical flavor and metal exposure tests. Powder coating cans with coating weights equivalent to liquid sprayed cans (normally 200 mg. per can having a 40 square inch surface area) have consistently been equal to or better than conventional liquid sprayed cans in the same test pack.

Coating thickness measurements of can bodies which were powder coated at progressively increasing coating times reveal that the coating builds up within the can body in a particular sequence. First, at very short times (less than 0.100 second) most of the powder is deposited near the entrance end of the can. Slightly later (less than 0.200 second), the coating thickness at the entrance and exit ends are about equal, with relatively less powder having been deposited in the middle of the can body. Finally (after about 0.200 second) a relatively uniform deposition has occurred, although the coating weight at mid-can is still less than at either end. A slightly thicker coating at each end of the can body is considered advantageous in order for the coating to withstand the abuse of the end attachment.

Although only a preferred embodiment of the invention has been specifically illustrated and described herein, it is to be understood that minor variations may be made therein without departing from the spirit and the scope of the invention, as defined by the appended claims.

What we claim as new is:

1. An apparatus for electrostatically coating the interior of a tubular member with a powder, said apparatus comprising a supply tube and a recovery tube positioned in axial alignment and being axially spaced to have a tubular member received therebetween in adjacent relation, means for supplying powder to said supply tube for flow therethrough and into a tubular member positioned between said supply tube and said recovery tube, a first corona electrode positioned within said supply tube for charging powder passing through said supply tube, and a second corona electrode positioned within said recovery tube for cooperation with said first corona electrode to form an electrical field between said first and second corona electrodes in the space between said supply tube and said recovery tube with said electrical field forming means for additionally charging powder deposited in a tubular body adjacent opposite ends thereof.

2. The apparatus of claim 1 wherein said means for supplying powder to said supply tube includes a supply passage materially smaller than said supply tube, and there is positioned between said supply passage and said supply tube a diverter for directing powder radially outwardly within said supply tube wherein powder flowing through said supply tube is concentrated adjacent the internal surface of said supply tube.

3. The apparatus of claim 2 wherein said supply tube has an internal cross section substantially corresponding with the internal cross section of the tubular member intended to be coated.

4. The apparatus of claim 2 wherein said supply tube has an entrance end of a curved increasing cross section cooperating with said diverter to effect the concentrated flow of powder adjacent the internal surface of said supply tube, said diverter terminating in advance of said curved entrance end.

5. The apparatus of claim 1 together with a holder for a tubular member to be coated, said holder being movable into axial alignment with said supply tube and said return tube, and having means for fixedly positioning a tubular member between said supply tube and said return tube.

6. An apparatus for use in electrostatically coating the interior of a tubular member with a powder, said apparatus comprising a supply tube, means including a supply passage materially smaller than said supply tube for supplying powder to said supply tube, and a diverter positioned between said supply passage and said supply tube for directing powder radially outwardly within said supply tube wherein powder flowing through said supply tube is concentrated adjacent the internal surface of said supply tube, said supply tube having an entrance end of a curved increasing cross section cooperating with said diverter to effect the concentrated flow of powder adjacent the internal surface of said supply tube, and said diverter terminating in advance of said curved entrance end.

7. The apparatus of claim 6 together with a corona electrode carried by said diverter and extending substantially axially through said supply tube from said diverter past said curved entrance end.

8. The apparatus of claim 7 wherein said supply tube has an exit end, and said corona electrode extends to a point closely adjacent said exit end.

9. A method of obtaining a uniform thin coating on the interior of a tubular member throughout the length thereof, said method comprising the steps of providing a supply tube and a return tube in axial alignment and spaced apart longitudinally a distance substantially equal to the length of the tubular member to be coated, positioning a tubular member between the supply tube and the return tube in alignment therewith, directing powder into the tubular member from the supply tube, and electrostatically charging the powder both within the supply tube and within the tubular member by means of energized corona electrodes positioned in both the supply tube and the return tube.

10. The method of claim 8 wherein powder supplied to the supply tube is mechanically radially outwardly diverted to concentrate the flow of powder adjacent the inner surfaces of the supply tube and the tubular member.

11. The method of claim 9 wherein said tubular member is fixed against rotation during the directing of powder thereinto.

* * * * *